US012624597B1

(12) United States Patent
Han et al.

(10) Patent No.: US 12,624,597 B1
(45) Date of Patent: May 12, 2026

(54) INTEGRATED STEAM DRILL

(71) Applicant: Nothwest Institute of Eco-Environment and Resources, Chinese Academy of Sciences, Lanzhou (CN)

(72) Inventors: Haidong Han, Lanzhou (CN); Donghui Shangguan, Lanzhou (CN)

(73) Assignee: Nothwest Institute of Eco-Environment and Resources, Chinese Academy of Sciences, Lanzhou (CN)

( * ) Notice: Subject to any disclaimer, the term of this patent is extended or adjusted under 35 U.S.C. 154(b) by 0 days.

(21) Appl. No.: 19/405,629

(22) Filed: Dec. 2, 2025

(30) Foreign Application Priority Data

Sep. 8, 2025 (CN) ..... 202511270569.4

(51) Int. Cl.
*E21B 7/18* (2006.01)
*E21B 7/00* (2006.01)
*E21B 10/60* (2006.01)

(52) U.S. Cl.
CPC ..... *E21B 7/18* (2013.01); *E21B 7/008* (2013.01); *E21B 10/60* (2013.01)

(58) Field of Classification Search
CPC ..... E21B 7/18; E21B 7/008; E21B 10/60
See application file for complete search history.

(56) References Cited

U.S. PATENT DOCUMENTS 4,366,860 A * 1/1983 Donaldson ..... E21B 36/02 431/243
2015/0198025 A1* 7/2015 Baird ..... E21B 36/02 166/58
2024/0418066 A1* 12/2024 Thompson ..... F22B 27/16

FOREIGN PATENT DOCUMENTS

WO WO1982001214 A1 * 4/1982

OTHER PUBLICATIONS

Northwest Institute of Eco-Environment and Resources, Chinese Academy of Sciences (Applicant), Claims (allowed) of CN202511270569.4, Sep. 8, 2025.
CNIPA, Notification to grant patent right for invention in CN202511270569.4, Oct. 23, 2025.

* cited by examiner

*Primary Examiner* — Crystal J Lee

(57) ABSTRACT

An integrated steam drill includes a drill rod. The drill rod includes a drill bit. A steam generator and an air-liquid mixing assembly are sequentially provided at positions of the drill rod facing toward the drill bit in that order. The air-liquid mixing assembly includes a liquid storage component and an air pipeline. The air pipeline is connected to an atomizer including an air-liquid mixing chamber. The steam generator is internally provided with a coil pipe and a combustion mechanism. An inlet end of the coil pipe is connected to an outlet end of the air pipeline. The combustion mechanism faces toward the coil pipe and is configured for connecting an external gas source. An end of the drill bit is connected to the steam generator, and another end of the (Continued)

drill bit is provided with a nozzle. The nozzle is connected to an outlet end of the coil pipe.

10 Claims, 3 Drawing Sheets

INTEGRATED STEAM DRILL

CROSS-REFERENCE TO RELATED APPLICATION

This application claims priority to Chinese Patent Application No. 202511270569.4, filed on Sep. 8, 2025, which is herein incorporated by reference in its entirety.

TECHNICAL FIELD

The disclosure relates to the technical field of steam drills, and more particularly to an integrated steam drill.

BACKGROUND

In research on glaciers, an operation of drilling holes on ice surfaces is frequently required to extract ice cores for physical analysis, install ablation stakes on the ice surfaces, detect subsurface ice structures, or detect physical properties within ice.

Glacier drill rigs are classified into two categories: core-drilling rigs and hole-drilling rigs. The core-drilling rigs are mainly used to extract the ice cores. Although the core-drilling rigs can also form glacier drilling holes simultaneously; due to issues such as bulky structures, numerous auxiliary equipment, and slow drilling speeds, the core-drilling rigs are rarely used in glaciological measurements where to drill holes is a main objective. The hole-drilling rigs mainly include steam drills, hot water drills, electric heating drills, etc. Due to issues of large overall weight, high energy consumption, and slow drilling speed of the hot water drills and the electric heating drills, the steam drills are widely used for glacier drilling at present.

A steam drill consists of a steam generator, a drill bit, a water pipe, etc. During operation, the steam generator is placed steadily on an ice surface, and 4 liters (L) to 5 L of clean water is pre-filled in a pressure vessel of the steam generator. A gas furnace at a bottom of the steam generator can heat the water in the pressure vessel to boil and generate steam. When a pressure of the steam reaches 0.2 megapascal (MPa) to 0.3 MPa, a valve is opened to allow the steam to be sprayed out through the water pipe and the drill bit for drilling in the ice. The drill bit of the steam drill is a straight-through copper tube with a length of 60 centimeters (cm), and one or more nozzles are provided on a head part of the drill bit to facilitate the steam spraying. When the pressure of the steam drops to a range of 0.05 MPa to 0.1 MPa, the valve is closed, and the above process is repeated when the pressure of the steam increases.

The steam drills in the art have exposed some insurmountable shortcomings in operation, such as: (1) in order to reduce a weight of the steam drill and make it easy to carry in glacier areas, the steam generators is made of aluminum, and a thickness of a wall of the pressure vessel is relatively thin, with a working pressure generally less than 0.3 MPa; therefore, the steam drills in the art are limited in drilling depth due to low working pressure; (2) the steam drills in the art use a split design of the steam generator and the drill bit; the steam with high-temperature generated by the steam generator is transported to the drill bit through the water pipe and then sprayed out for drilling; during this process, although the water pipe adopts insulation measures to minimize a heat loss of the steam during transportation, because a drilling hole is full of molten water, a considerable amount of heat is still lost through a wall of the water pipe due to increasing water temperature inside the drilling hole; additionally, as the drilling depth increases, a heat dissipation of the water pipe also increases rapidly, thereby reducing a drilling speed. In addition, during a process of the steam with high temperature reaching the drill bit through the water pipe, the pressure and temperature of the steam at the nozzle of the drill bit are decreased due to the steam expanding inside the water tube. When the water pipe is long, a pressure loss and the heat loss caused by the steam expanding inside the water tube will be difficult to ignore, directly affecting drilling efficiency of the drill bit.

SUMMARY

To solve the aforementioned technical problems, the disclosure provides an integrated steam ice drill.

An integrated steam drill provided by the disclosure includes a drill rod. The drill rod includes a drill bit. A steam generator and an air-liquid mixing assembly are sequentially provided at positions of the drill rod facing toward the drill bit in that order. The air-liquid mixing assembly includes a liquid storage component with a liquid storage chamber, and an air pipeline configured for connecting an external high-pressure air source. The air pipeline is connected to an atomizer. An air-liquid mixing chamber connected to an upstream and a downstream of the air pipeline is defined inside the atomizer. The atomizer is configured to atomize water stored in the liquid storage chamber to thereby obtain atomized water droplets for flowing into the air-liquid mixing chamber and mixing with high-pressure air in the air pipeline to form an air-liquid mixture. The steam generator is internally provided with a coil pipe and a combustion mechanism. An inlet end of the coil pipe is connected to an outlet end of the air pipeline. The combustion mechanism faces toward the coil pipe and is configured for connecting an external gas source. The combustion mechanism is configured to heat the air-liquid mixture in the coil pipe into steam by burning gas. An end of the drill bit is connected to the steam generator, and a nozzle is disposed on another end of the drill bit. The nozzle is connected to an outlet end of the coil pipe.

In an embodiment, the atomizer is an atomizing tube. The air-liquid mixing chamber is an inner chamber of the atomizing tube. An outer wall of the atomizing tube is defined with multiple atomizing holes. A filter with a tubular shape is sleeved outside the atomizing tube to filter impurities in the water. The air pipeline extends into the liquid storage chamber. The atomizing tube is disposed inside the liquid storage chamber. The atomizing tube is connected to the upstream and the downstream of the air pipeline.

In an embodiment, a flow channel is defined inside the nozzle, and a diameter of the flow channel gradually increases along a flow direction of a medium in the flow channel.

In an embodiment, the combustion mechanism includes a gas-air mixing chamber facing toward the coil pipe. A spray hole is defined on the gas-air mixing chamber. An ignition component is disposed on a side of the spray hole. The gas-air mixing chamber is configured for connecting the external gas source and the external high-pressure air source. The gas-air mixing chamber is configured to mix external air from the external high-pressure source and external gas from the external gas source to obtain a gas-air mixture and spray out the gas-air mixture from the spray hole. The ignition component is configured to ignite the gas-air mixture.

In an embodiment, the steam generator further includes a combustion chamber. The coil pipe and the combustion mechanism are disposed inside the combustion chamber. A drill bit connector is detachably connected to an end of the combustion chamber, and an end of the drill bit connector facing away from the combustion chamber is detachably connected to the drill bit. The drill bit connector is provided with a first connecting pipe. An end of the first connecting pipe is connected to the coil pipe disposed inside the combustion chamber, and another end of the first connecting pipe is connected to the nozzle disposed inside the drill bit.

In an embodiment, the liquid storage component and the combustion chamber are both tubular bodies. An end of the liquid storage component is threaded to an end of the combustion chamber. A connecting piece is disposed inside the liquid storage component or the combustion chamber, and the connecting piece is configured to separate the liquid storage chamber of the liquid storage component from an inner chamber of the combustion chamber.

In an embodiment, a second connecting pipe, a third connecting pipe, a fourth connecting pipe, and a fifth connecting pipe are disposed on the connecting piece. An end of the second connecting pipe is configured for connecting the external gas source. An end of the third connecting pipe is configured for connecting the external high-pressure air source. Another end of the second connecting pipe and another end of the third connecting pipe are both connected to an inner chamber of the gas-air mixing chamber. An end of the fourth connecting pipe is connected to the outlet end of the air pipeline, and another end of the fourth connecting pipe is connected to the inlet end of the coil pipe. An end of the fifth connecting pipe is connected to the inner chamber of the combustion chamber, and another end of the fifth connecting pipe is connected to an exhaust pipe leading to an outside.

In an embodiment, the end of the second connecting pipe facing toward the liquid storage component is connected to a gas pipeline for connecting the external gas source. An end of the third connecting pipe facing toward the liquid storage component is connected to an air pipe for connecting the external high-pressure air source. An end of each of the air pipeline, the exhaust pipe, the gas pipeline, and the air pipe extends into the liquid storage component.

In an embodiment, a side of the combustion chamber is defined with a flame observation hole. A transparent glass with high-temperature resistance is installed in the flame observation hole.

In an embodiment, the coil pipe is a conical spiral coil pipe.

Compared with the related art, the disclosure has the following beneficial effects.

1. By disposing the atomizer on the air pipeline, on the one hand, the water output from the liquid storage chamber can be atomized into the atomized water droplets, and on the other hand, a place for the mixing of the high-pressure air and the atomized water droplets can be provided. When the high-pressure air flows through the atomizer, the atomized water droplets will be carried by the high-pressure air. Therefore, when the high-pressure air carrying the atomized water droplets (also referred to as the air-liquid mixture) flows through the coil pipe, the air-liquid mixture can be quickly heated up and pressurized into steam, and the steam is sprayed out through the nozzle. This design can generate the steam with a pressure higher than that of steam generated by conventional steam drills, significantly increasing a drilling depth of the integrated steam drill.

2. Due to a direct connection between the drill bit and the steam generator, and a direct connection between the outlet end of the coil pipe and the nozzle disposed inside the drill bit, the steam can be immediately transported to the nozzle after being generated. Therefore, the integrated steam drill provided by the disclosure can reduce heat loss of the steam during transportation. Compared with split-type steam ice drills in the art, the integrated steam drill provided by the disclosure can maintain thermal energy and pressure of the steam to a maximum extent; even when the drilling depth increases, the heat loss of the steam due to a transportation distance can be reduced, thereby ensuring working efficiency of the drill bit.

3. By configuring the steam generator including the coil pipe and the combustion mechanism, the combustion mechanism can directly heat the air-liquid mixture inside the coil pipe by burning the gas into the steam with a certain pressure. A structure of the coil pipe can more efficiently convert heat of the gas into heat energy of the air-liquid mixture, allowing the air-liquid mixture to quickly vaporize to generate the steam with high pressure inside the sealed coil pipe. Therefore, the integrated steam drill provided by the disclosure can break through a pressure limit of 0.3 MPa and drill deeper into ice layers.

DESCRIPTION OF NUMERALS

Figure 1:
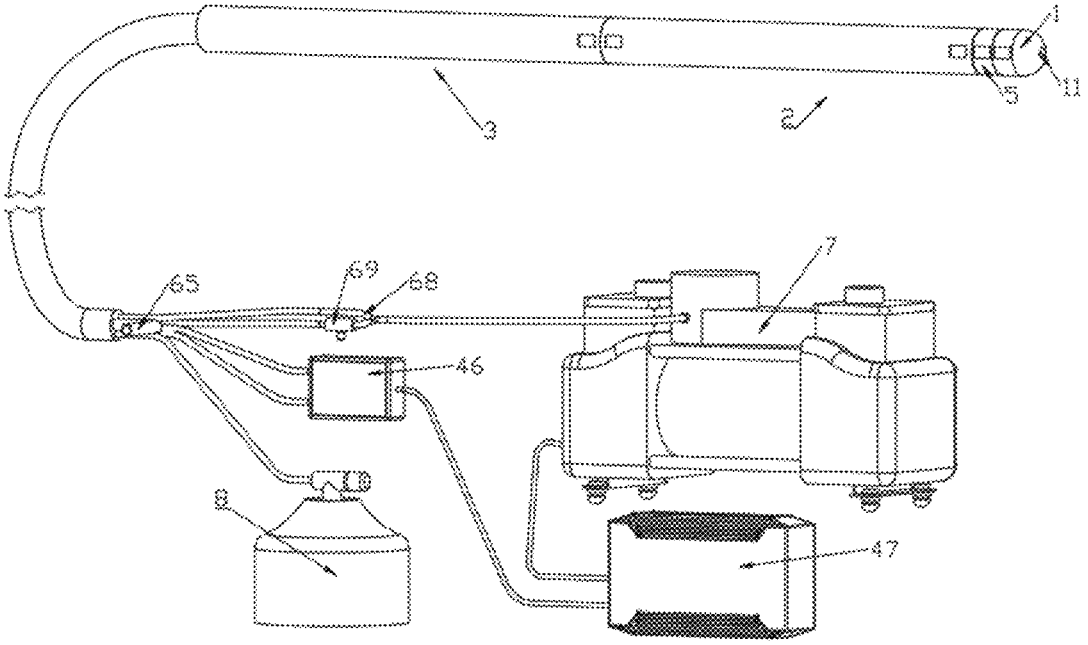
FIG. 1 illustrates a schematic structural diagram of an integrated steam drill according to embodiment 1 of the disclosure.
Figure 2:
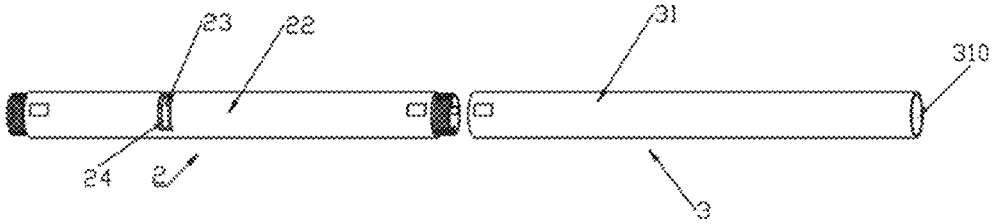
FIG. 2 illustrates a schematic structural diagram of a steam generator and an air-liquid mixing assembly of the integrated steam drill according to the embodiment 1 of the disclosure.

1: drill bit; 11: nozzle; 12: flow channel; 2: steam generator; 21: coil pipe; 22: combustion chamber; 23: flame observation hole; 24: transparent glass; 3: air-liquid mixing assembly; 31: liquid storage component; 310: liquid storage chamber; 32: air pipelines; 4: combustion mechanism; 41: gas-air mixing chamber; 42: ignition component; 43: spray hole; 44: ignition needle; 45: flame-sensing needle; 46: ignition high-voltage pack; 47: battery; 5: drill bit connector; 51: first connecting pipe; 6: connecting piece; 61: second connecting pipe; 62: third connecting pipe; 63: fourth connecting pipe; 64: fifth connecting pipe; 65: exhaust pipe; 66: gas pipeline; 67: air pipe; 68: diverter tee; 69: first valve; 7: air pump; 8: gas tank; 9: atomizing tube; 91: filter; 92: atomizing hole; 93: air-liquid mixing chamber; 10: pipe clamp.

DETAILED DESCRIPTION OF EMBODIMENTS

An embodiment of the disclosure will be described in detail with reference to attached drawings, but it should be understood that a scope of protection of the disclosure is not limited by embodiments of the disclosure.

In description of the disclosure, it should be understood that directional or orientational relationships indicated by terms "center", "longitudinal", "transverse", "length", "width", "thickness", "up", "down", "front", "back", "left", "right", "vertical", "horizontal", "top", "bottom", "inside", "outside", "axial", "radial", and "circumferential" are based on directional or orientational relationships illustrated in the attached drawings, and are only for convenience of describing technical solutions of the disclosure and simplifying description, and do not indicate or imply that a device or an element referred to must have a specific orientation, be constructed and operated in a specific orientation, and therefore cannot be understood as limiting the disclosure.

Embodiment 1

As illustrated in FIG. 1 through FIG. 4, an integrated steam drill provided by the disclosure includes a drill rod. The drill rod includes a drill bit 1. A steam generator 2 and an air-liquid mixing assembly 3 are sequentially provided at positions of the drill rod facing toward the drill bit 1 in that order. The air-liquid mixing assembly 3 includes a liquid storage component 31 with a liquid storage chamber 310, and an air pipeline 32 configured for connecting an external high-pressure air source. The air pipeline 32 is connected to an atomizer. An air-liquid mixing chamber 93 connected to an upstream and a downstream of the air pipeline 32 is defined inside the atomizer. Water stored in the liquid storage chamber 310 is atomized into atomized water droplets by the atomizer, then flows into the air-liquid mixing chamber 93, and mixes with high-pressure air in the air pipeline 32 to form an air-liquid mixture. The steam generator 2 is internally provided with a coil pipe 21 and a combustion mechanism 4. An inlet end of the coil pipe 21 is connected to an outlet end of the air pipeline 32. The combustion mechanism 4 faces toward the coil pipe 21 and is configured for connecting an external gas source. The combustion mechanism 4 is configured to heat the air-liquid mixture in the coil pipe 21 from the air pipeline 32 into steam by burning gas. An end of the drill bit 1 is connected to the steam generator 2, and a nozzle 11 is disposed on another end of the drill bit 1. The nozzle 11 is connected to an outlet end of the coil pipe 21.

In the embodiment, air in the air pipeline 32 is the high-pressure air.

Figure 4:
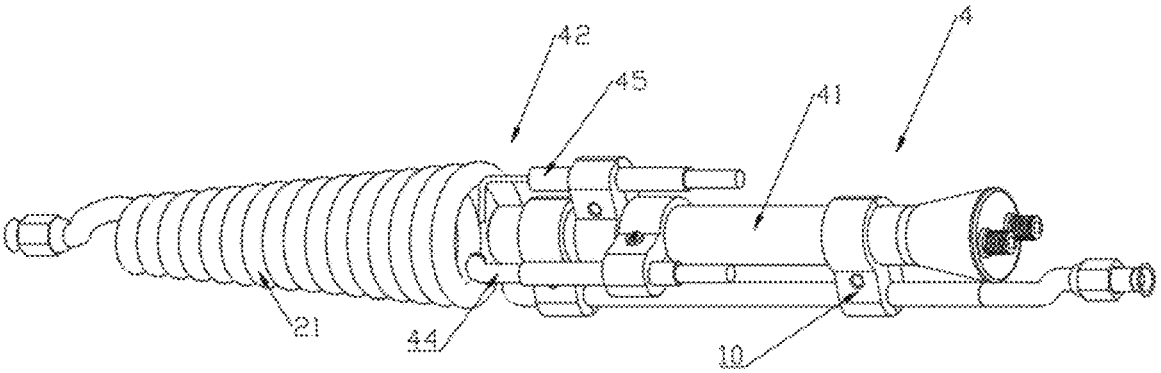
FIG. 4 illustrates a schematic structural diagram of a coil pipe and a combustion mechanism of the integrated steam drill according to the embodiment 1 of the disclosure.
Figure 5:
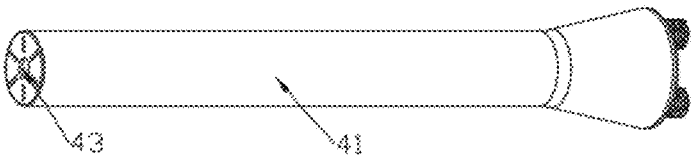
FIG. 5 illustrates a schematic structural diagram of a gas-air mixing chamber of the integrated steam drill according to the embodiment 1 of the disclosure.

As illustrated in FIG. 4 and FIG. 5, the combustion mechanism 4 includes a gas-air mixing chamber 41 facing toward the coil pipe 21. A spray hole 43 is defined on the gas-air mixing chamber 41. An ignition component 42 is disposed on a side of the spray hole 43. The gas-air mixing chamber 41 is configured for connecting the external gas source and the external high-pressure air source. External air and external gas are mixed in the gas-air mixing chamber 41 to obtain a gas-air mixture; the gas-air mixture is sprayed out from the spray hole 43 and ignited by the ignition component 42.

In the embodiment, the air pipeline 32 and the coil pipe 21 are connected through a connecting pipe. The gas-air mixing chamber 41 is connected to the connecting pipe through a pipe clamp 10.

In the embodiment, the ignition component 42 as a whole is prior art and includes an ignition needle 44 configured to ignite the gas-air mixture sprayed from the spray hole 43, a flame-sensing needle 45 configured to monitor flame state in real time, an ignition high-voltage pack 46, and a battery 47. The ignition needle 44, the flame-sensing needle 45, and the battery 47 are all electrically connected to the ignition high-voltage pack 46. The ignition high-voltage pack 46 in the art can integrate ignition and flame-sensing functions, so at the same time, the ignition high-voltage pack 46 has a control function.

Figure 3:
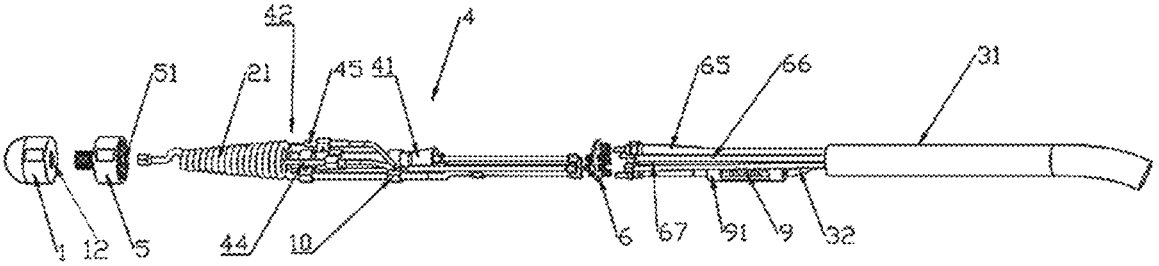
FIG. 3 illustrates a schematic structural diagram of the steam generator of the integrated steam drill according to the embodiment 1 of the disclosure.
Figure 6:
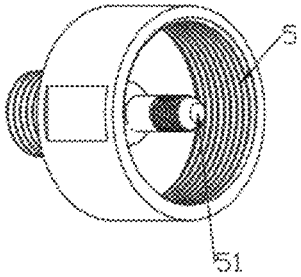
FIG. 6 illustrates a schematic structural diagram of a drill bit connector of the integrated steam drill according to the embodiment 1 of the disclosure.

As illustrated in FIG. 1, FIG. 3, and FIG. 6, the steam generator 2 further includes a combustion chamber 22. The coil pipe 21 and the combustion mechanism 4 are disposed inside the combustion chamber 22. A drill bit connector 5 is detachably connected to an end of the combustion chamber 22, and an end of the drill bit connector 5 facing away from the combustion chamber 22 is detachably connected to the drill bit 1. The drill bit connector 5 is provided with a first connecting pipe 51. An end of the first connecting pipe 51 is connected to the coil pipe 21 disposed inside the combustion chamber 22, and another end of the first connecting pipe 51 is connected to the nozzle 11 disposed inside the drill bit 1.

In the embodiment, the drill bit connector 5 as a whole is prior art.

Figure 7:
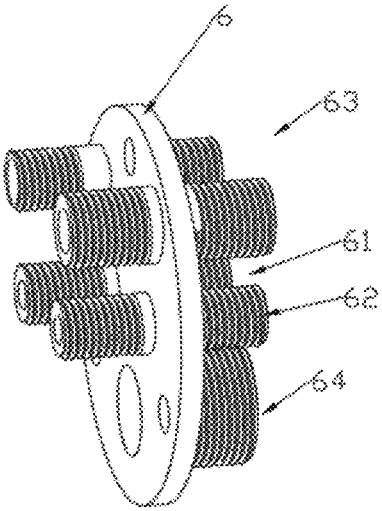
FIG. 7 illustrates a schematic structural diagram of a connecting piece of the integrated steam drill according to the embodiment 1 of the disclosure.

As illustrated in FIG. 1, FIG. 3, and FIG. 7, the liquid storage component 31 and the combustion chamber 22 are both tubular bodies. An end of the liquid storage component 31 is threaded to an end of the combustion chamber 22. A connecting piece 6 is disposed inside the combustion chamber 22, and the connecting piece 6 is configured to separate the liquid storage chamber 310 of the liquid storage component 31 from an inner chamber of the combustion chamber 22.

In the embodiment, due to the drill bit being threaded to the drill bit connector 5, the drill bit connector 5 being threaded to the combustion chamber 22, and the combustion chamber 22 being threaded to the liquid storage component 31, to facilitate disassembly and maintenance of these components, opposite sides of an outer wall of each of the drill bit 1, the drill bit connector 5, the combustion chamber 22, and the liquid storage component 31 are all defined with wrench engagement surfaces.

A second connecting pipe 61, a third connecting pipe 62, a fourth connecting pipe 63, and a fifth connecting pipe 64 are disposed on the connecting piece 6. An end of the second connecting pipe 61 is configured for connecting the external gas source. An end of the third connecting pipe 62 is configured for connecting the external high-pressure air source. Another end of the second connecting pipe 61 and another end of the third connecting pipe 62 are both connected to an inner chamber of the gas-air mixing chamber 41. An end of the fourth connecting pipe 63 is connected to the outlet end of the air pipeline 32, and another end of the fourth connecting pipe 63 is connected to the inlet end of the coil pipe 21. An end of the fifth connecting pipe 64 is connected to the inner chamber of the combustion chamber 22, and another end of the fifth connecting pipe 64 is connected to an exhaust pipe 65 leading to an outside.

The end of the second connecting pipe 61 facing toward the liquid storage component 31 is connected to a gas pipeline 66 for connecting the external gas source. The end of the third connecting pipe 62 facing toward the liquid storage component 31 is connected to an air pipe 67 for connecting the external high-pressure air source. An end of each of the air pipeline 32, the exhaust pipe 65, the gas pipeline 66, and the air pipe 67 extends into the liquid storage component 31.

In the embodiment, the air pipeline 32, the exhaust pipe 65, the gas pipeline 66, and the air pipe 67 are bundled together through wire harness bellows or waterproof tape to form a pipe bundle.

A side of the combustion chamber 22 is defined with a flame observation hole 23. A transparent glass 24 with high-temperature resistance is installed in the flame observation hole 23.

Figure 8:
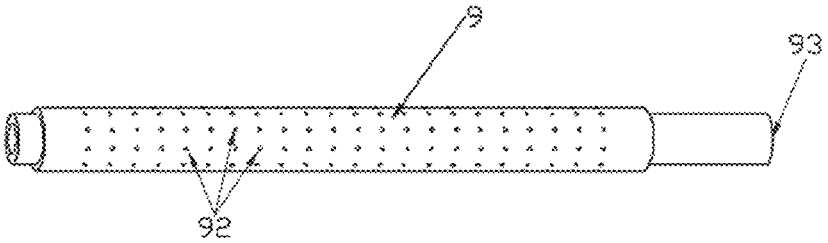
FIG. 8 illustrates a schematic structural diagram of an atomizing tube of the integrated steam drill according to the embodiment 1 of the disclosure.

As illustrated in FIG. 3 and FIG. 8, the atomizer is an atomizing tube 9. The air-liquid mixing chamber 93 is an inner chamber of the atomizing tube 9. An outer wall of the atomizing tube 9 is defined with multiple atomizing holes 92. A filter 91 with a tubular shape is sleeved outside the atomizing tube 9 to filter impurities in the water. The air pipeline 32 extends into the liquid storage chamber 310. The atomizing tube 9 is disposed inside the liquid storage chamber 310. The atomizing tube 9 is connected to the upstream and the downstream of the air pipeline 32.

In the embodiment, a diameter of each of the multiple atomizing holes 92 is in a range of 0.2 milliliters (mm) to 0.6 mm. The filter 91 is made of high-density filter cotton.

The coil pipe 21 is a conical hollow spiral coil pipe. In the embodiment, the coil pipe 21 is made of copper.

A flow channel 12 is defined inside the nozzle 11, and a diameter of the flow channel 12 gradually increases along a flow direction of a medium in the flow channel 12.

In the embodiment, the external high-pressure air source is an air pump 7, and an outlet of the air pump 7 is connected to the air pipeline 32 and the air pipe 67 through a diverter tee 68. The external gas source is a gas tank 8, and the gas tank 8 is connected to the gas pipeline 66. A first valve 69 is disposed on the air pipe 67.

A working principle of the integrated steam drill is as follows.

The drill rod formed by connecting the drill bit 1, the steam generator 2, and the air-liquid mixing assembly 3 is vertically stood on an ice surface, and clear water is filled into the liquid storage chamber 310 from a top end of the liquid storage component 31. Switches of the air pump 7 and the gas tank 8 are turned on to introduce a small amount of air and gas into the gas-air mixing chamber 41. The ignition component 42 ignites the gas-air mixture sprayed from the spray hole 43. The flame state is monitored through the flame observation hole 23. The air pump 7 and the gas tank 8 are adjusted to make a flame stable, firepower moderate and a pressure of the steam sprayed from the nozzle 11 strong. During this process, the high-pressure air in the air pipeline 32 carrying the atomized water droplets flows to the coil pipe 21 and is heated rapidly to obtain heated and pressurized steam. The heated and pressurized steam is sprayed out through the nozzle 11 at an end of the drill bit 1 to impact and erode an ice body for drilling.

When the liquid storage component 31 is completely submerged in a drilling hole, molten water can flow into the liquid storage component 31 from the top end of the liquid storage component 31 to form a positive circulation of water supply. Exhaust gas generated by flame combustion impacts the coil pipe 21 and the drill bit connector 5, then flows in an opposite direction to a side where the connector 6 is located, and is discharged through the exhaust pipe 65. During transportation of the exhaust gas in the exhaust pipe 65, heat exchange occurs between the exhaust gas and the molten water outside the exhaust pipe 65, causing a rapid decrease in temperature of the exhaust gas, thereby avoiding damage to the pipelines in the pipe bundle caused by high temperature of the exhaust gas.

When the flame goes out unexpectedly during drilling, the flame-sensing needle 45 sends back a high-level signal to the ignition high-voltage pack 46 to light a flameout indicator lamp of the ignition high-voltage pack 46 and trigger the ignition high-voltage pack 46 to ignite automatically. When ignition is successful, the flameout indicator lamp goes out. When the ignition still fails after several seconds, the integrated steam drill is stopped immediately for trouble-shooting.

A reading change of a pressure gauge of the air pump 7 is observed. When a reading of the pressure gauge continues to rise, it may indicate that the nozzle 11 is blocked by sediment in the ice body. At this time, the integrated steam drill should be stopped immediately to clear air paths and gas paths.

The above embodiments of the disclosure are only a few embodiments of the disclosure, but the embodiments of the disclosure are not limited herein. Any changes that can be thought of by those skilled in the art should fall within the scope of protection of the disclosure.

What is claimed is:

1. An integrated steam drill, comprising a drill rod; wherein the drill rod comprises a drill bit (1), and a steam generator (2) and an air-liquid mixing assembly (3) are sequentially provided at positions of the drill rod facing toward the drill bit (1) in that order;

wherein the air-liquid mixing assembly (3) comprises a liquid storage component (31) with a liquid storage chamber (310), and an air pipeline (32) configured for connecting an external high-pressure air source; the air pipeline (32) is connected to an atomizer, an air-liquid mixing chamber (93) connected to an upstream and a downstream of the air pipeline (32) is defined inside the atomizer, and the air-liquid mixing chamber (93) is connected to the liquid storage chamber (310); the atomizer is configured to atomize water stored in the liquid storage chamber (310) to thereby obtain atomized water droplets for flowing into the air-liquid mixing chamber (93) and mixing with high-pressure air in the air pipeline (32) to form an air-liquid mixture;

wherein the steam generator (2) is internally provided with a coil pipe (21) and a combustion mechanism (4); an inlet end of the coil pipe (21) is connected to an outlet end of the air pipeline (32); the combustion mechanism (4) faces toward the coil pipe (21) and is configured for connecting an external gas source; and the combustion mechanism (4) is configured to heat the air-liquid mixture in the coil pipe (21) into steam by burning gas; and wherein an end of the drill bit (1) is connected to the steam generator (2), and a nozzle (11) is disposed on another end of the drill bit (1); and the nozzle (11) is connected to an outlet end of the coil pipe (21).

2. The integrated steam drill as claimed in claim 1, wherein the atomizer is an atomizing tube (9), the air-liquid mixing chamber (93) is an inner chamber of the atomizing tube (9), an outer wall of the atomizing tube (9) is defined with a plurality of atomizing holes (92), and a filter (91) with a tubular shape is sleeved outside the atomizing tube (9) to filter impurities in the water; and wherein the air pipeline (32) extends into the liquid storage chamber (310), the atomizing tube (9) is disposed inside the liquid storage chamber (310), and the atomizing tube (9) is connected to the upstream and the downstream of the air pipeline (32).

3. The integrated steam drill as claimed in claim 1, wherein a flow channel (12) is defined inside the nozzle (11), and a diameter of the flow channel (12) gradually increases along a flow direction of a medium in the flow channel (12).

4. The integrated steam drill as claimed in claim 1, wherein the combustion mechanism (4) comprises a gas-air mixing chamber (41) facing toward the coil pipe (21); a spray hole (43) is defined on the gas-air mixing chamber (41), and an ignition component (42) is disposed on a side of the spray hole (43); and wherein the gas-air mixing chamber (41) is configured for connecting the external gas source and the external high-pressure air source; the gas-air mixing chamber (41) is configured to mix external air from the external high-pressure air source and external gas from the external gas source to obtain a gas-air mixture and spray out the gas-air mixture from the spray hole (43); and the ignition component (42) is configured to ignite the gas-air mixture.

5. The integrated steam drill as claimed in claim 4, wherein the steam generator (2) further comprises a combustion chamber (22), and the coil pipe (21) and the combustion mechanism (4) are disposed inside the combustion chamber (22); and wherein a drill bit connector (5) is detachably connected to an end of the combustion chamber (22), and an end of the drill bit connector (5) facing away from the combustion chamber (22) is detachably connected to the drill bit (1); and the drill bit connector (5) is provided with a first connecting pipe (51), an end of the first connecting pipe (51) is connected to the coil pipe (21) disposed inside the combustion chamber (22), and another end of the first connecting pipe (51) is connected to the nozzle (11) defined inside the drill bit (1).

6. The integrated steam drill as claimed in claim 5, wherein the liquid storage component (31) and the combustion chamber (22) are both tubular bodies; an end of the liquid storage component (31) is threaded to an end of the combustion chamber (22); a connecting piece (6) is disposed inside the liquid storage component (31) or the combustion chamber (22), and the connecting piece (6) is configured to separate the liquid storage chamber (310) of the liquid storage component (31) from an inner chamber of the combustion chamber (22).

7. The integrated steam drill as claimed in claim 6, wherein a second connecting pipe (61), a third connecting pipe (62), a fourth connecting pipe (63), and a fifth connecting pipe (64) are disposed on the connecting piece (6); and an end of the second connecting pipe (61) is configured for connecting the external gas source, an end of the third connecting pipe (62) is configured for connecting the external high-pressure air source, and another end of the second connecting pipe (61) and another end of the third connecting pipe (62) are both connected to an inner chamber of the gas-air mixing chamber (41); an end of the fourth connecting pipe (63) is connected to the outlet end of the air pipeline (32), and another end of the fourth connecting pipe (63) is connected to the inlet end of the coil pipe (21); and an end of the fifth connecting pipe (64) is connected to the inner chamber of the combustion chamber (22), and another end of the fifth connecting pipe (64) is connected to an exhaust pipe (65) leading to an outside.

8. The integrated steam drill as claimed in claim 7, wherein the end of the second connecting pipe (61) facing toward the liquid storage component (31) is connected to a gas pipeline (66) for connecting the external gas source, and the end of the third connecting pipe (62) facing toward the liquid storage component (31) is connected to an air pipe (67) for connecting the external high-pressure air source; and an end of each of the air pipeline (32), the exhaust pipe (65), the gas pipeline (66), and the air pipe (67) extends into the liquid storage component (31).

9. The integrated steam drill as claimed in claim 8, wherein a side of the combustion chamber (22) is defined with a flame observation hole (23), and a transparent glass (24) with high-temperature resistance is installed in the flame observation hole.

10. The integrated steam drill as claimed in claim 1, wherein the coil pipe (21) is a conical spiral coil pipe.

* * * * *